US009793614B1

(12) United States Patent
Berezin et al.

(10) Patent No.: US 9,793,614 B1
(45) Date of Patent: Oct. 17, 2017

(54) MINIATURE PATCH ANTENNA

(71) Applicant: GM GLOBAL TECHNOLOGY OPERATIONS LLC, Detroit, MI (US)

(72) Inventors: Vyacheslav Berezin, Newmarket (CA); Shaun S. Marshall, Port Perry (CA); Gholamreza Z. Rafi, Kitchener (CA); Safieddin Safavi-Naeini, Waterloo (CA)

(73) Assignees: GM GLOBAL TECHNOLOGY OPERATIONS LLC, Detroit, MI (US); UNIVERSITY OF WATERLOO, Waterloo (CA)

( * ) Notice: Subject to any disclaimer, the term of this patent is extended or adjusted under 35 U.S.C. 154(b) by 13 days.

(21) Appl. No.: 15/099,218

(22) Filed: Apr. 14, 2016

(51) Int. Cl.
*H01Q 1/38* (2006.01)
*H01Q 13/10* (2006.01)
*H01Q 9/04* (2006.01)

(52) U.S. Cl.
CPC ..... *H01Q 13/106* (2013.01); *H01Q 9/0407* (2013.01)

(58) Field of Classification Search
CPC ..... H01Q 1/2208; H01Q 1/38; H01Q 23/00; H01Q 13/106; H01Q 1/24
USPC ..... 343/700 MS, 767, 770, 829, 846
See application file for complete search history.

(56) References Cited

U.S. PATENT DOCUMENTS 4,063,246 A * 12/1977 Greiser ..... H01Q 9/0407 343/700 MS
4,197,544 A * 4/1980 Kaloi ..... H01Q 1/48 343/700 MS
4,197,545 A * 4/1980 Favaloro ..... H01Q 13/106 343/700 MS
4,873,529 A * 10/1989 Gibson ..... H01Q 9/0435 343/700 MS
6,097,345 A * 8/2000 Walton ..... H01Q 1/1271 343/700 MS
6,121,930 A * 9/2000 Grangeat ..... H01Q 9/0407 343/700 MS

* cited by examiner

*Primary Examiner* — Tho G Phan
(74) *Attorney, Agent, or Firm* — Lorenz & Kopf, LLP

(57) ABSTRACT

A multi-slot patch antenna is provided. The multi-slot patch antenna includes a central patch including cut corners; a plurality of strips of varying widths, the plurality of strips surrounding the central patch; and a plurality of slots of varying widths, the plurality of slots being positioned between each of the plurality of strips, wherein one of the plurality of slots is positioned between a first one of the plurality of strips and the central patch.

20 Claims, 3 Drawing Sheets

MINIATURE PATCH ANTENNA

TECHNICAL FIELD

Embodiments of the subject matter described herein relate generally to patch antennas. More particularly, embodiments of the subject matter relate to a miniaturized directional patch antenna.

BACKGROUND

The prior art is replete with radio frequency (RF) and microwave antenna designs, structures, and configurations. Such antennas are utilized in many different applications to wirelessly transmit and receive signals that convey information or data. For example, modern buildings, vehicles, consumer electronic devices might utilize a number of antennas that receive signals throughout the RF spectrum. Generally, antennas are designed to accommodate certain technical specifications, and desirable antenna characteristics (e.g., high front-to-back radiation ratio, wider bandwidth) usually require a larger sized antenna. Antenna size is a critical parameter for particular applications, and larger sized antennas may limit the applications for which an antenna may be used.

Accordingly, it is desirable to maximize desirable antenna characteristics for a smaller antenna. Furthermore, other desirable features and characteristics will become apparent from the subsequent detailed description and the appended claims, taken in conjunction with the accompanying drawings and the foregoing technical field and background.

BRIEF SUMMARY

Some embodiments of the present disclosure provide a multi-slot patch antenna. The multi-slot patch antenna includes a central patch including cut corners; a plurality of strips of varying widths, the plurality of strips surrounding the central patch; and a plurality of slots of varying widths, the plurality of slots being positioned between each of the plurality of strips, wherein one of the plurality of slots is positioned between a first one of the plurality of strips and the central patch.

Some embodiments of the present disclosure provide a patch antenna. The patch antenna includes a square patch comprising cut corners, the square patch comprising: a central patch; a plurality of surrounding strips comprising metal material; and a plurality of c-shaped slots comprising dielectric material, each of the plurality of c-shaped slots positioned between two of the plurality of surrounding strips.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

A miniature patch antenna configured in the manner described herein can be used to receive and/or transmit signals in an environment limited with regard to space available for antenna placement. Relevant applications for a miniature patch antenna may include, without limitation, home and/or office applications, automotive applications, aircraft onboard applications, consumer electronics applications, Internet of Things (IoT) applications, and/or any other application for which a miniature patch antenna may be compatible.

Figure 1:
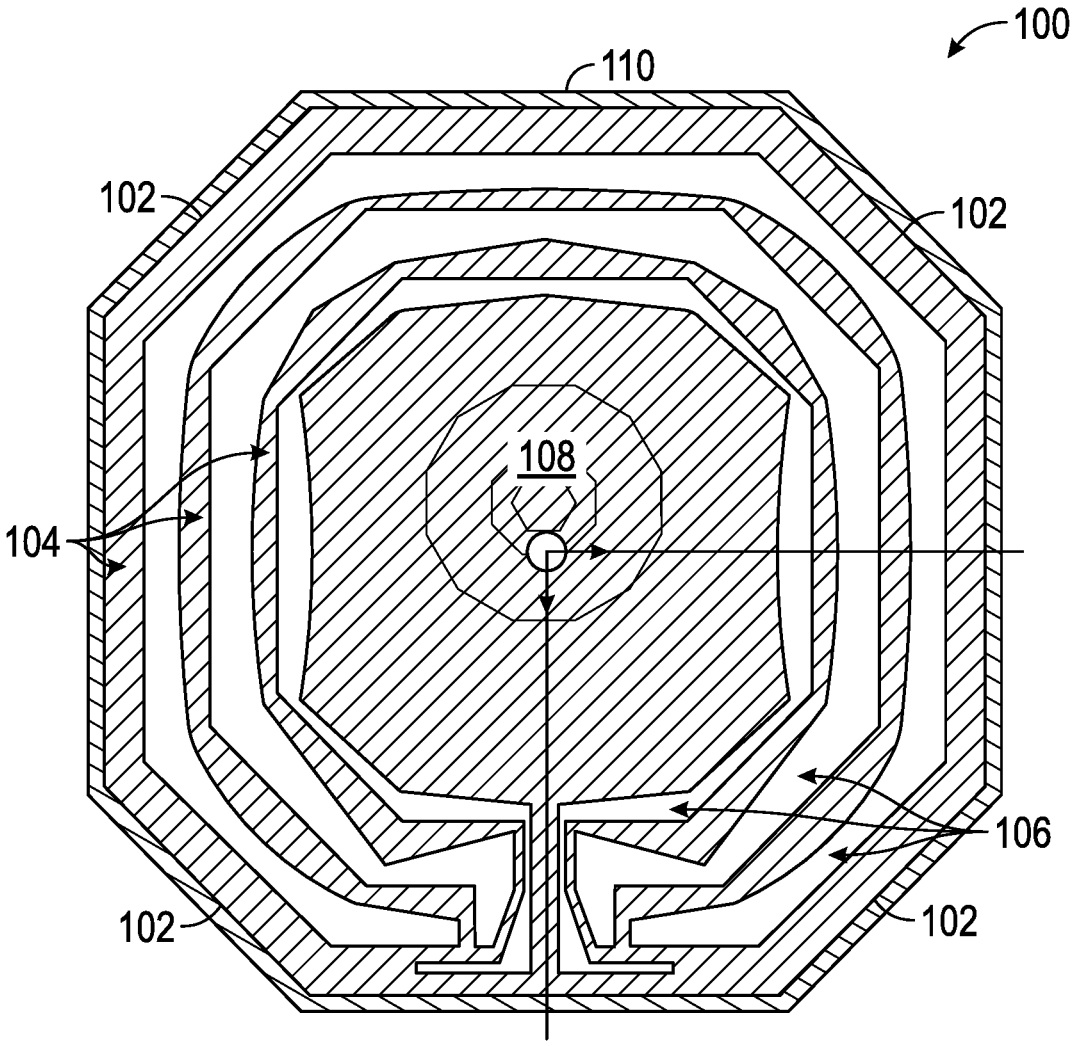
FIG. 1 is a top view of an embodiment of a miniature patch antenna, in accordance with the disclosed embodiments.

Turning now to the figures, FIG. 1 is a top view of an embodiment of a miniature patch antenna 100, in accordance with the disclosed embodiments. It should be appreciated that FIG. 1 depicts a simplified embodiment of the miniature patch antenna 100, and that some implementations of the miniature patch antenna 100 may include additional elements or components. Generally, a patch antenna is a single rectangular (or circular) conductive plate that is spaced above a ground plane. Patch antennas are attractive due to their low profile and ease of fabrication. The miniature patch antenna 100 is configured to maximize efficiency, bandwidth, and scalability, using a high front-to-back ratio, while maintaining a small antenna implementation size. The following description provides additional details regarding these characteristics.

The miniature patch antenna 100 may be implemented using copper or any other radio frequency (RF) substrate materials. Particular materials may be used to increase the antenna efficiency of the miniature patch antenna 100. The miniature patch antenna 100 may be implemented as a rigid or conformal patch antenna. Exemplary embodiments of the miniature patch antenna 100 produce seventy percent efficiency or greater, and comprise a size of one-fifth (⅕) to one-sixth (⅙) of applicable wavelength ($\lambda$).

As shown, the miniature patch antenna 100 is a square patch antenna with four cut corners 102. The size of corner cut in patch is optimized to miniaturize antenna. The miniature patch antenna 100 includes a central patch 108 surrounded by a plurality of strips 104. The central patch 108 acts to create the main resonance of the miniature path c antenna 100. In certain embodiments, the central patch 108 may be implemented as an irregular polygon. For example, the illustrated central patch 108 includes ten sides, however, it should be appreciated that other implementations of the central patch 108 may include greater or fewer polygonal sides.

The plurality of strips 104 surround the central patch 108. The embodiment shown includes three strips 104 surrounding the central patch 108. However, it should be appreciated that other embodiments may include any number of strips 104. A particular number (i.e., quantity) of strips 104 are used for the miniature patch antenna 100 to obtain a high front-to-back ratio and to maintain a smaller size. The plurality of strips 104 are of varying widths (i.e., the strips 104 are not linear), and are generally implemented using a metal material. Each of the plurality of slots 106 is positioned either (i) between the central patch 108 and one of the plurality of strips 104, or (ii) between two of the plurality of strips 104. Like the plurality of strips 104, the plurality of slots 106 are of varying widths. The plurality of slots 106 are generally implemented using a dielectric material. The plurality of slots 106 are "c-shaped", and the embodiment shown includes three c-shaped slots 106. The plurality of strips 104, the plurality of slots 106, and the central patch 108 create the multi-resonance structure, which increases the antenna bandwidth. The gaps (i.e., the plurality of slots 106) between strips 104 are defined as tuning slots. Here, the strip width (i.e., the width of each of the plurality of strips 104) and the slot width (i.e., the width of each of the plurality of slots 106) are the parameters which are optimized to reduce the antenna back lobe radiation of the miniature patch antenna 100.

The plurality of strips 104 and the plurality of slots 106 are positioned in a periodic, alternating pattern. The periodic pattern of the strips 104 and slots 106 is a repeated pattern of a radiation material (e.g., the strips 104) and a dielectric material (e.g., the slots 106), which produces a high-impedance ground plane effect. The strips 104 act as reflectors, for the high-impedance ground plane, to reflect the waves back to the central patch 108. The plurality of strips 104 impede the propagation of a wave (i.e., the transmitted signal) from the central patch 108 toward the outside edge 110 of the miniature patch antenna 100. (As shown, the outside edge 110 surrounds the outside of the miniature patch antenna 100, including the central patch 108, the plurality of strips 104, and the plurality of slots 106).

Each of the plurality of slots 106 is configured to generate a resonant frequency in close proximity to the central patch 108. Here, a quantity of the plurality of slots 106 generates the same quantity of resonant frequencies in close proximity to each other and to the central patch 108, thereby expanding bandwidth of the miniature patch antenna 100. The plurality of slots 106 are configured to expand the bandwidth of the miniature patch antenna 100, and also to add directivity to the pattern of the miniature patch antenna 100. Each of the plurality of slots 106 is of varying width, and the width of each of the slots 106 is optimized to add directionality to the function of the miniature patch antenna 100. Each of the plurality of slots 106 directs a radiated signal in one direction, while suppressing radiation in another direction The antenna components (the central patch 108 and the surrounding strips 104) are optimized to increase the main lobe radiation. The triple C-shaped slots could act as radiating elements to keep radiation directed toward the front side of antenna, instead of radiating toward the back lobe.

The miniature patch antenna 100 is configured to maximize efficiency, bandwidth, and scalability, using a high front-to-back ratio, while maintaining a small antenna implementation size. The size of the miniature patch antenna 100 has been chosen to maintain high isolation to any materials located around the miniature patch antenna 100, such as a printed circuit board. This feature helps to increase efficiency of the miniature patch antenna 100.

Efficiency

Antenna efficiency may also be referred to as radiation efficiency, and is defined as the ratio of the total power radiated by an antenna to the net power accepted by the antenna from the connected transmitter. Efficiency may be expressed as a percentage (less than 100), and is frequency dependent. Efficiency can also be described in decibels. Efficiency frequently decreases as the size of an antenna decreases. Embodiments of the miniature patch antenna 100 are associated with radiation efficiency levels of greater than seventy percent (>70%). On the transmit side, significant efficiency indicates that it is not required to supply a larger amount of power to the miniature patch antenna 100, to generate the same signal strength. On the receive side, efficiency directly affects the noise performance.

Bandwidth

In certain embodiments, the miniature patch antenna 100 uses a center frequency of 2.4 GHz-2.48 GHz. This frequency range represents that currently used by the IEEE 802.11 Wi-Fi and IEEE 802.15.1 Bluetooth specifications. A bandwidth of 50-70 MHz is associated with embodiments of the miniature patch antenna 100 that use a center frequency of 2.4 GHz. However, the absolute bandwidth is variable, based on scalability of the center frequency used by the miniature patch antenna 100.

Small Size/Scalability

The miniature patch antenna 100 is scalable. The width and length of the miniature patch antenna 100 are determined by the center frequency and the center wavelength. As described above, some embodiments of the miniature patch antenna 100 are tuned to a center frequency of 2.4 GHz. However, other embodiments of the miniature patch antenna 100 may use other center frequencies and center wavelengths. In these other embodiments, the ratio of the center wavelength and the center frequency remains the same, but the actual dimensions of the length and width of the miniature patch antenna 100 scales up or down. For example, reducing the miniature patch antenna 100 to one-tenth of size renders operability of the miniature patch antenna 100 at ten times the frequency, while all other properties of the miniature patch antenna 100 remain the same.

The size of the miniature patch antenna 100 is scalable, and is determined as a fraction of applicable wavelength. In certain embodiments, the size of the miniature patch antenna 100 comprises a length of one-eighth (⅛) of wavelength (i.e., $\lambda/8$, where $\lambda$=wavelength). In some embodiments, the size of the miniature patch antenna 100 comprises a length of one-seventh (⅐) of wavelength (i.e., $\lambda/7$). For example, when the size of the miniature patch antenna 100 comprises a length of $\lambda/7$, and is tuned to a frequency of 2.4 GHz and a wavelength of 12 cm, then the size (i.e., length) of the miniature patch antenna 100 is approximately 1.7-1.8 cm. However, the same design can be applied when the miniature patch antenna 100 is tuned to a frequency of 10 GHz and a wavelength of 3 cm, then the size of the miniature patch antenna 100 is approximately 4 mm.

Front-to-Back Ratio

Figure 2:
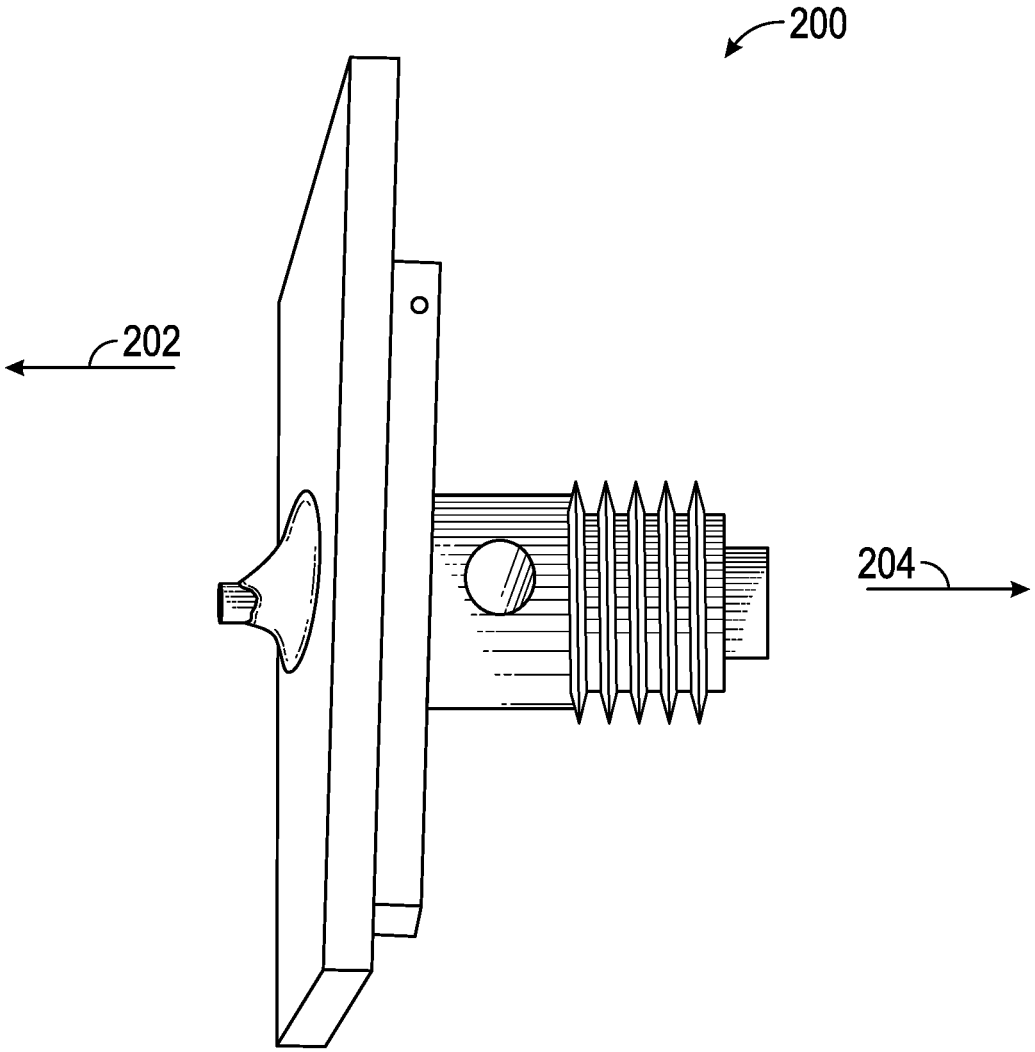
FIG. 2 is a side view of an embodiment of a miniature patch antenna, in accordance with the disclosed embodiments.

Certain parameters are used to limit the radiation propagation to the back, and to form the energy to the front of the miniature patch antenna 100. These parameters may include, without limitation: a specific number (i.e., quantity) of strips 104, a specific length of the strips 104, and a specific width for the strips 104. FIG. 2 is a side view of an embodiment of a miniature patch antenna 200, in accordance with the disclosed embodiments. It should be noted that the miniature patch antenna 200 can be implemented with the miniature patch antenna 100 depicted in FIG. 1. In this regard, the miniature patch antenna 200 shows certain elements and components of the miniature patch antenna 100 in more detail. In the embodiment shown, the front of the miniature patch antenna 200 propagates a signal in the front direction 202, while limiting the propagation of a signal in the back direction 204. The miniature patch antenna 200 radiates significantly more in the front direction 202 than the back direction 204. This high front-to-back ratio applies to both the transmit and receive functions of the miniature patch antenna 200.

Figure 3:
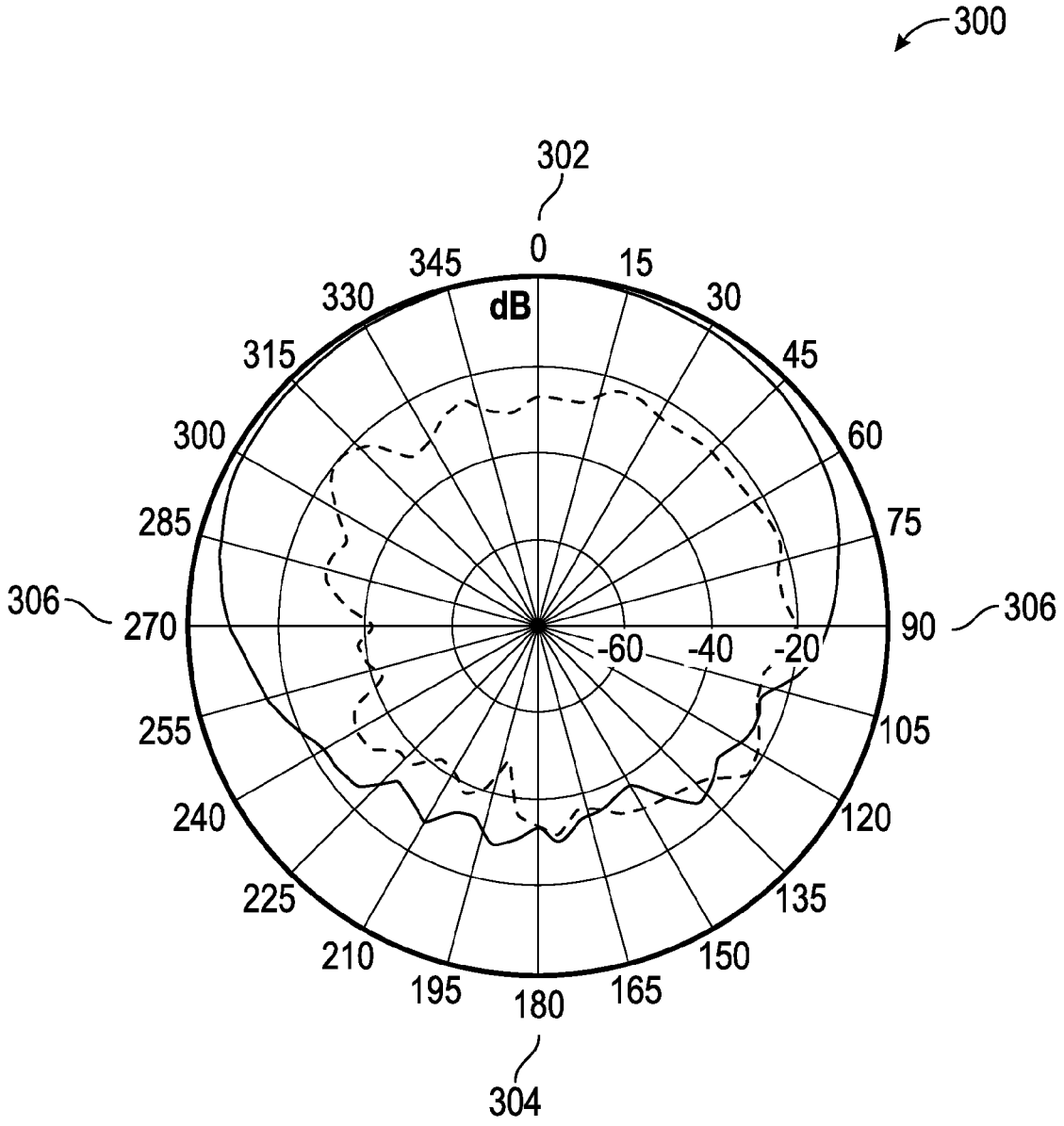
FIG. 3 is a diagram of a radiation pattern for a miniature patch antenna, in accordance with the disclosed embodiments.

FIG. 3 is a diagram of a radiation pattern 300 for a miniature patch antenna, in accordance with the disclosed embodiments. Generally, a radiation pattern 300 defines the variation of the power radiated by an antenna as a function of the direction away from the antenna. The radiation pattern 300 is illustrated as a pattern in polar coordinates, and includes a main lobe 302, a back lobe 304, and side lobes 306. A lobe may be defined as any part of the radiation pattern 300 that is surrounded by regions of relatively weaker radiation, and the various lobes are shown as any part of the plot that protrudes from the radiation pattern 300. As shown, the radiation pattern 300 is directed toward the main lobe 302, illustrating that the miniature patch antenna is a directional antenna which radiates its energy more effectively toward the front of the antenna than toward the back of the antenna.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

The present disclosure refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically.

In addition, certain terminology may also be used in the present disclosure for the purpose of reference only, and thus are not intended to be limiting. For example, terms such as "upper", "lower", "above", and "below" refer to directions in the drawings to which reference is made. Terms such as "front", "back", "rear", "side", "outboard", and "inboard" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

For the sake of brevity, conventional techniques related to radio frequency (RF) antenna design, and RF signal propagation may not be described in detail herein. In addition, those skilled in the art will appreciate that embodiments of the miniature patch antennas described herein may be practiced in conjunction with any number of applications and installations.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A multi-slot patch antenna, comprising:

a central patch including cut corners;

a plurality of strips of varying widths, the plurality of strips surrounding the central patch; and a plurality of slots of varying widths, the plurality of slots being positioned between each of the plurality of strips, wherein one of the plurality of slots is positioned between a first one of the plurality of strips and the central patch.

2. The multi-slot patch antenna of claim 1, wherein each of the plurality of strips comprises a metal material; and wherein each of the plurality of slots comprises a dielectric material.

3. The multi-slot patch antenna of claim 1, wherein each of the plurality of slots comprises a c-shaped slot.

4. The multi-slot patch antenna of claim 1, wherein the multi-slot patch antenna comprises a triple c-shaped slot antenna; and wherein the plurality of slots comprises three c-shaped slots.

5. The multi-slot patch antenna of claim 1, wherein the multi-slot patch antenna comprises a length of one-sixth (1/6) of wavelength.

6. The multi-slot patch antenna of claim 1, wherein the multi-slot patch antenna comprises a length of one-fifth (1/5) of wavelength.

7. The multi-slot patch antenna of claim 1, wherein the multi-slot patch antenna is configured to use a center frequency range of 2.4-2.48 GHz.

8. The multi-slot patch antenna of claim 1, wherein arrangement of the plurality of strips deviates from a linear arrangement.

9. The multi-slot patch antenna of claim 1, wherein the plurality of strips and the plurality of slots are arranged in a periodic pattern comprising a repeated pattern of radiating material and dielectric material; and wherein the periodic pattern produces a high-impedance ground-plane effect.

10. The multi-slot patch antenna of claim 1, wherein the multi-slot patch antenna comprises a conformal multi-slot patch antenna.

11. A patch antenna, comprising:

a square patch comprising cut corners, the square patch comprising:

a central patch;

a plurality of surrounding strips comprising metal material; and a plurality of c-shaped slots comprising dielectric material, each of the plurality of c-shaped slots positioned between two of the plurality of surrounding strips.

12. The patch antenna of claim 11, wherein the square patch is configured to operate using 2.4 GHz as a center frequency.

13. The patch antenna of claim 11, wherein positioning of the plurality of surrounding strips comprises a repeated pattern; and wherein the repeated pattern of strips produces a high-impedance ground plane effect.

14. The patch antenna of claim 11, wherein each of the plurality of surrounding strips act as reflectors of a high-impedance ground plane, in order to reflect signal waves back to the central patch; and wherein each of the plurality of surrounding strips impedes propagation of the signal waves from the central patch toward an edge of the square patch.

15. The patch antenna of claim 11, wherein the square patch comprises a quantity of surrounding strips, the plurality comprising the quantity;

wherein the quantity limits radiation propagation to a back side of the patch antenna.

16. The patch antenna of claim 11, wherein the square patch comprises a conformal square patch;

wherein the plurality of surrounding strips comprises a plurality of conformal strips; and wherein the plurality of c-shaped slots comprises plurality of conformal c-shaped slots.

17. The patch antenna of claim 11, wherein the patch antenna comprises a length of one-sixth (1/6) of wavelength.

18. The patch antenna of claim 11, wherein the patch antenna comprises a length of one-fifth (1/5) of wavelength.

19. The patch antenna of claim 11, wherein the plurality of c-shaped slots is configured to expand bandwidth of the patch antenna by generating resonant frequencies in close proximity and near the square patch.

20. The patch antenna of claim 11, wherein the plurality of c-shaped slots is configured to add directivity to a pattern of the patch antenna.

* * * * *